United States Patent [19]

Novinger

[11] Patent Number: 4,479,270

[45] Date of Patent: Oct. 30, 1984

[54] INSULATED CLOTHING AND OTHER LIKE FABRIC PRODUCTS

[76] Inventor: William Novinger, 322 W. 57th St., Suite 48E, New York, N.Y. 10019

[21] Appl. No.: 310,639

[22] Filed: Oct. 13, 1981

[51] Int. Cl.[3] ..... A41B 1/12; D02G 3/00

[52] U.S. Cl. ..... 2/69; 428/398

[58] Field of Search ..... 428/36, 224, 398, 394; 2/69

[56] References Cited

U.S. PATENT DOCUMENTS

| | | | |
|---|---|---|---|
| 3,857,753 | 12/1974 | Hasen | 428/398 |
| 4,305,983 | 12/1981 | Hoppe et al. | 428/398 |
| 4,363,688 | 12/1982 | Yasue | 428/398 |
| 4,364,996 | 12/1982 | Sugiyama | 428/398 |
| 4,384,022 | 5/1983 | Fowler | 428/398 |
| 4,400,426 | 8/1983 | Aldrich | 428/398 |

*Primary Examiner*—Doris L. Troutman

*Attorney, Agent, or Firm*—Lackenbach Siegel Marzullo Presta & Aronson

[57] ABSTRACT

An insulated article comprising a plurality of tubular members juxtaposed to each other and insulating material retained in said tubular members. Examples of such insulated products include outerwear formed of a woven fabric made from insulated tubular members.

7 Claims, 17 Drawing Figures

FIG. 5
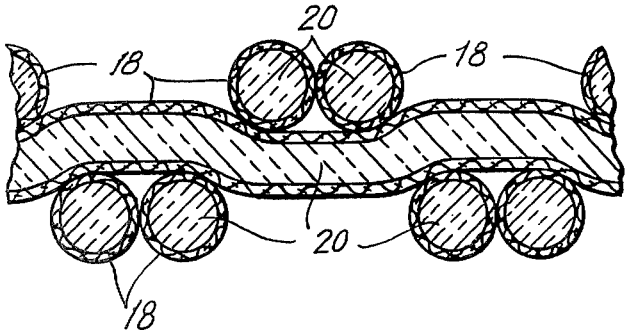
FIG. 6
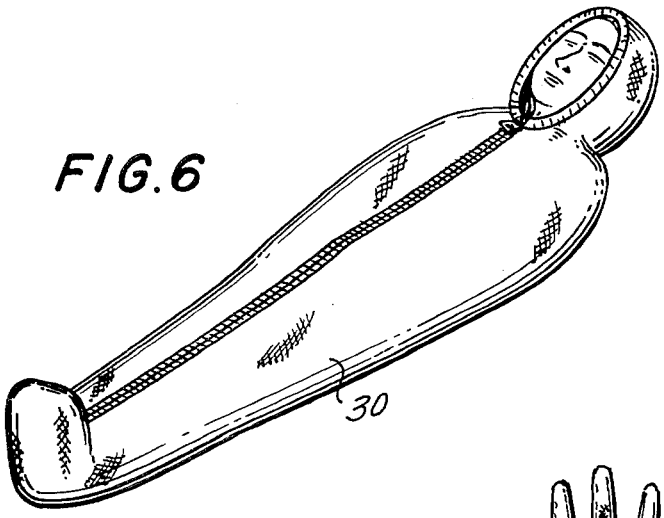
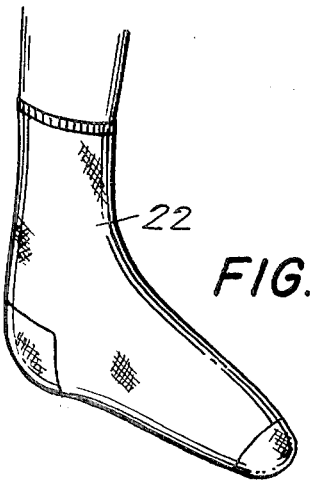
FIG. 7
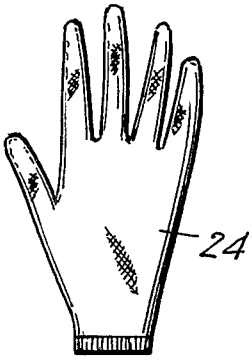
FIG. 8
FIG. 9
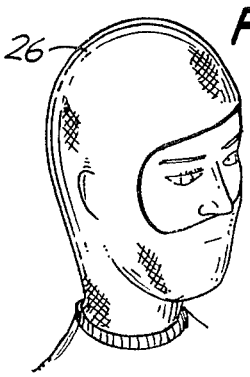
FIG. 10
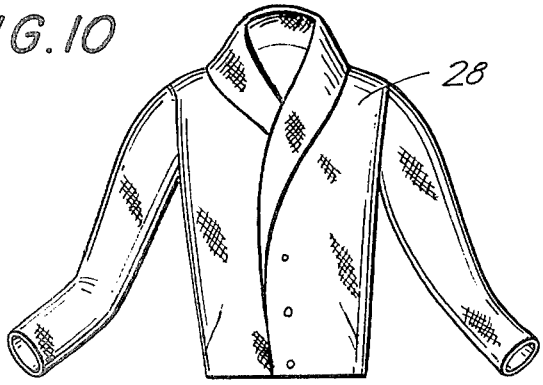

FIG. 11
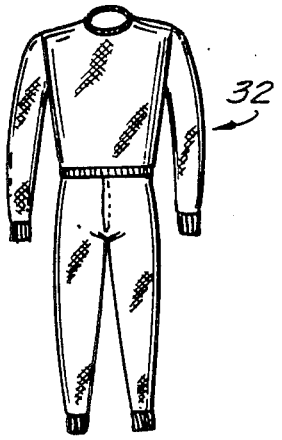
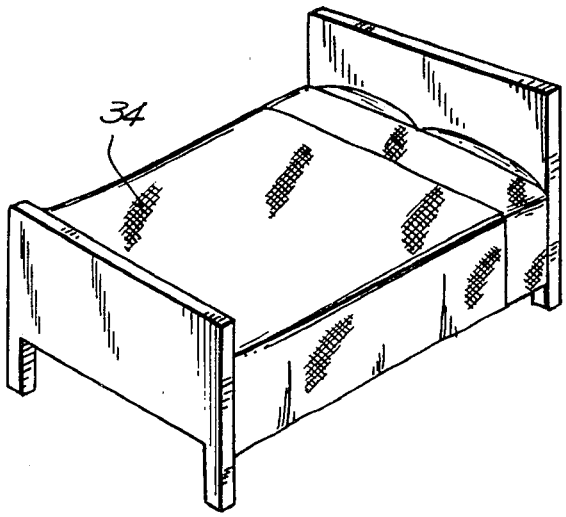
FIG. 12
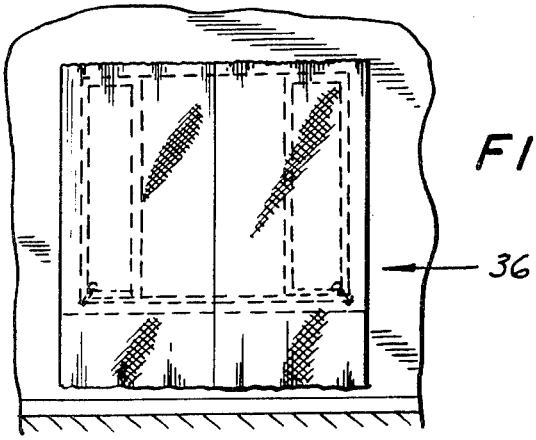
FIG. 13
FIG. 15
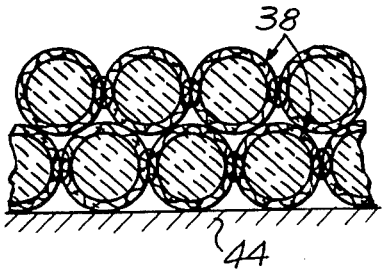
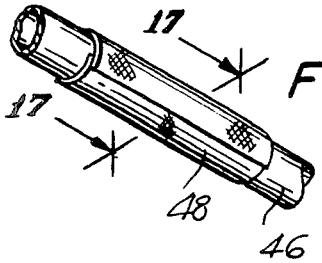
FIG. 16
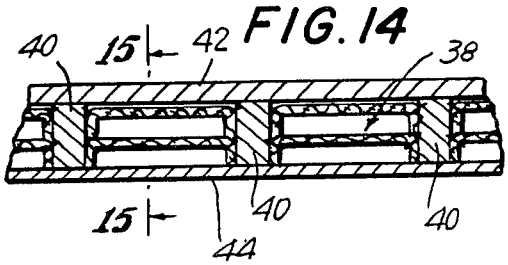
FIG. 14
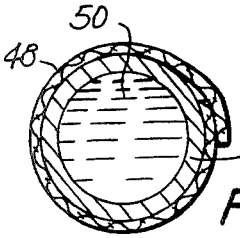
FIG. 17

INSULATED CLOTHING AND OTHER LIKE FABRIC PRODUCTS

This invention relates to an insulated fabric, and, more particularly, to insulated outerwear clothing, preferably formed as a tubular woven fabric, and other like insulated fabric products, such as coats and jackets, sleeping bags, drapes, blankets, insulation batts, etc.

BACKGROUND OF THE INVENTION

Today's age of high energy costs demands warmer clothing. However, although conventionally made clothing, such as outerwear coats and jackets, or outdoor suits may be made in layers with down or other insulating materials between the layers, none are made of an insulated tubular material woven in a pattern to form a fabric from which the novel clothing or other like fabric products can be manufactured.

In the prior art, U.S. Pat. Nos. 4,240,158 and 4,097,933 teach garments, such as pants and dresses, formed of helically joined pieces wound and joined along contiguous edges of adjacent convolutions of the helix by a continuous seam. The garment thus is essentially a plurality of strips of fabric material wound helically about an axis to form a continuous generally cylindrical body.

U.S. Pat. No. 3,154,792 discloses a bouffant garment made of a relatively small amount of material, that is, by using a single continuous strip of material with the skirt having no vertical seam from top to bottom, and wherein the material is oriented in a spiral of increasing diameter with the edges of the strip of material in overlapping relationship and with the adjacent edges of the spiralled length of material stitched together and contemporaneously shirred.

U.S. Pat. No. 3,377,974 deals with compartmented buoyant materials, and more particularly to a buoyant garment formed of parallel batts or segments of fibrous material separated by a water impermeable film. Such a structure exhibits greater buoyancy effect and thermal protection.

A further prior art reference is to U.S. Pat. No. 3,098,281 and it relates to braiding materials and to articles made therefrom, such as rugs. The rugs and similar coverings are formed from a braid having loops sewn together. The braided material is of a closed means and the material employed is a braiding strip in the form of a flat tube.

SUMMARY OF THE INVENTION

In accordance with the present invention, there is provided an improved insulated garment comprising an insulated tubular material forming a woven fabric product, such as a coat, jacket, bathrobe, drapes, blanket, insulating batt or other like product. The woven design can be of any type or form as the particular weaving pattern employed does not form part of the invention.

BRIEF DESCRIPTION OF THE DRAWINGS

The nature, object and advantages of the invention will be more fully understood from the following description of the preferred embodiments of the invention which are shown by way of example in the accompanying drawings in which:

FIG. 5 is a cross-sectional view along the line 5—5 of FIG. 3;

FIG. 6 is a perspective view of a sleeping bag made with the insulated fabric weave of the invention;

FIGS. 7–9 illustrate various accessories which may be made from any insulated fabric weave of the invention;

FIG. 10 is a jacket made of the insulated fabric weave;

FIG. 11 shows a pair of pajamas made of an insulated fabric weave;

FIG. 12 shows a blanket;

FIG. 13 illustrates a pair of drapes;

FIG. 14 shows a typical sectional-view through a studded wall, and illustrating insulated batts made of the fabric weave mounted between the studs;

FIG. 15 is a cross-sectional view taken along the line 15—15 of FIG. 14;

FIG. 16 shows a pipe insulated with the fabric of the present invention; and

FIG. 17 is a cross-sectional view along the line 17—17 of FIG. 16.

DESCRIPTION OF THE PREFERRED EMBODIMENTS

Figure 1:
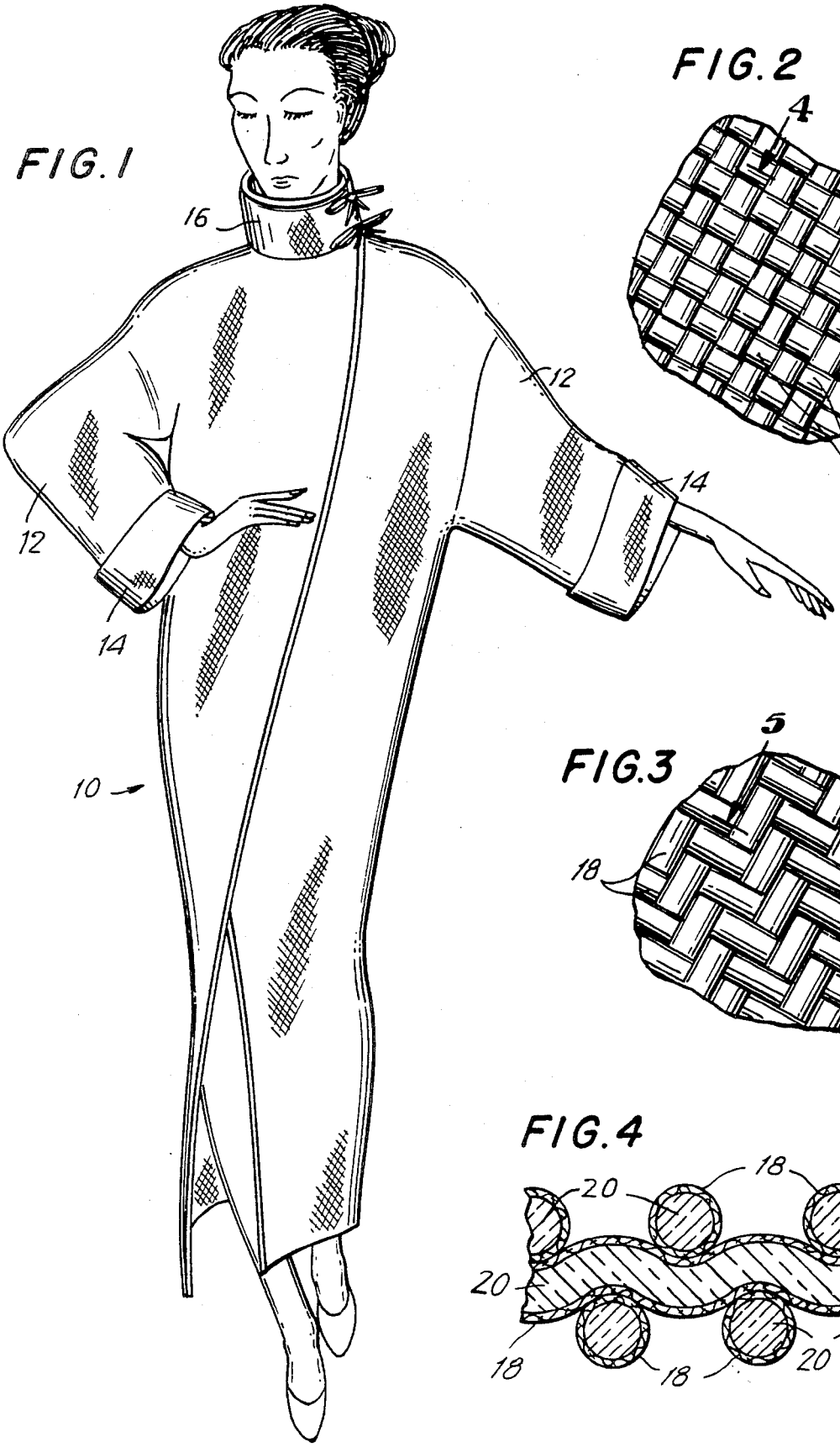
FIG. 1 is a perspective view of a garment made in accordance with the present invention.
Figure 2:
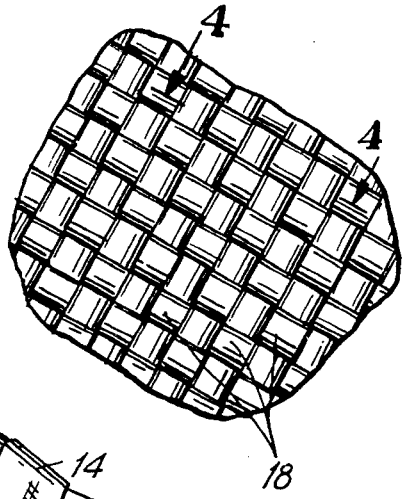
FIG. 2 is a fragmentary view of a simple woven pattern which may be used to form a garment made of the insulated fabric weave.
Figure 3:
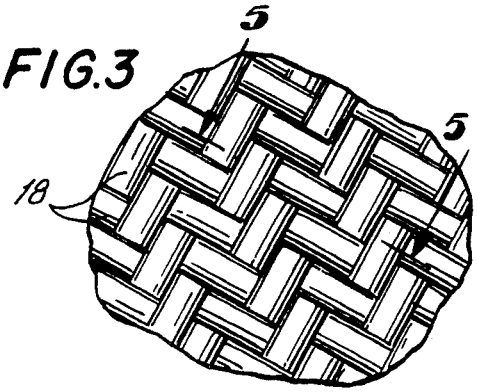
FIG. 3 is another alternate woven pattern which may be used in the practice of the invention.
Figure 4:
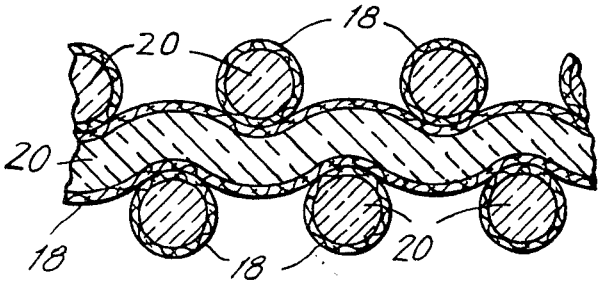
FIG. 4 is a cross-sectional view along the line 4—4 of FIG. 2.

Referring to FIGS. 1–5, there is shown an insulated fabric product in the form of a full length robe 10 having long sleeves 12 with cuffs 14 and a high Nehru-like collar 16. The form of the robe 10 can take any desired shape, but the fabric comprises an insulated tubular woven material, such as that shown in FIGS. 2 and 4, and FIGS. 3 and 5. As shown in FIGS. 2 and 4, a simple over and under weave pattern is illustrated but any well known weaving patterns may also be used in the practice of the invention. In FIGS. 4 and 5, the tubular material 18 is filled with any suitable insulating material, such as will be described hereinafter. In FIG. 5, a further weave pattern of over two and under one is illustrated to show how such a fabric weave would look to an observer.

In FIGS. 6–10, other accessories, such as sock 22, groove 24 hat 26, jacket 28, and sleeping bag 30 are other forms outerwear or sports clothing which lends themselves to further applications of the invention.

In a like manner, other examples of the invention may take the form of "Thermalwear" type of pajamas 32, as shown in FIG. 11 a bedspread or blanket 34, as shown in FIG. 12; a pair of drapes 36, as shown in FIG. 13; and wall insulating batts 38, formed of tubes suitably connected together to form at least one layer, as shown in FIG. 14. The batts 38 are suitably secured to the studs 40 between the outer wall 42 and the inner plaster board wall 44. The insulating batts 38 are simply tubular material the same as the clothing material from which clothing is made. In FIG. 15, the insulated woven pattern is obvious as shown in cross section, but as noted hereinabove, any type of well known weave patterns may be utilized so long as the tubular weave material is utilized in the practice of the present invention. Examples of weaves include plain weave structures, twill structures, shadow weave, canvas weave, and the intricate weave patterns which may be formed by related combinations and pattern variations. Other complex weave patterns are shown in "Color-and-Weave" by Margaret and Thomas Windeknecht, published by Van Nostrand Reinhold Company of N.Y., copyright 1981.

In FIGS. 16 and 17, a pipe 46 is insulated with the insulated fabric weave 48 of the invention so as to aid in maintaining the temperature of the fluid 50 passing through said pipe 46. It should, therefore, be recognized that the invention is applicable to many different situations requiring the need for insulating properties. The insulated tubular product of the invention is thus capable of a wide variety of applications as it is flexible, can be cut to size, and is otherwise adaptable to many other arrangements specifying high insulation qualities, low cost, good handleability and lightweight properties.

The tubular material, say in the form of a fabric may be suitable for any well known conventional sewing machines which can stitch a longitudinal seam on a strip of material formed as a flat tube, and thereafter turn the tube inside out so the raw edges are internally disposed. Such a tube can then be filled with any predetermined insulation material, depending upon the application and properties desired. For example, any of the following materials may be utilized as the insulating material; down, cotton, cork, paper, wood, water, foam materials, polyfill, glass and other like materials.

With respect to the fabric material for use in the manufacture of the tubular material of the invention, any suitable materials may be employed. For example, man made fabrics may be utilized, such as nylon, orlon, acrylics, and acetate. Other natural materials such as leathers, skins, suedes, etc. may also be employed if desired. In fact, even glass, metals, plastic/rubber and paper may be used in special applications but such materials may be more difficult to form or would have to be shaped in the hot stage prior to becoming rigid and inflexible.

Accordingly, although the invention is primarily directed to insulated outerwear fabricated from a fabric weave formed of the insulated tubular product of the invention, it should be noted that other non-clothing product applications are within the scope of the present patent application.

Although the present invention has been described in some detail by way of illustration and example for purposes of clarity of understanding, it will, of course, be understood that various changes and modifications may be made in the form, details, and arrangements of the parts without departing from the scope of the invention as set forth in the following claims.

What is claimed is:

1. A thermal insulating product comprising a plurality of elongated hollow elements; each of said elongated hollow elements being in the form of long thin tubes fabricated from a flexible fabric material; each of said long thin tubes having a longitudinal seam internally disposed so that the raw edges of said fabric material project into said elongated hollow elements; said long thin tubes being filled with a mixture of one or more soft insulating materials selected from the group consisting of down, cotton, cork, foam, polyfill and other like natural or synthetic materials; and said elongated hollow elements being woven into an insulating fabric structure pattern forming a cloth adapted to be used for making insulated clothing or like products.

2. A thermal insulating product comprising a plurality of elongated hollow elements; each of said elongated hollow elements being in the form of long thin tubes fabricated from a flexible fabric material; each of said long thin tubes being filled with a mixture of one or more insulating materials selected from the group consisting of down, cotton, cork, foam, polyfill and other like natural or synthetic materials; and said elongated hollow elements being connected together to form an insulating batt; and wherein said insulating batt is composed of one or more layers of said long thin tubes secured together in parallel to form said insulating batt.

3. A thermal insulating product comprising a plurality of elongated hollow elements; each of said elongated hollow elements being in the form of long thin tubes fabricated from a flexible fabric material; each of said long thin tubes having a longitudinal seam internally disposed so the raw edges of said fabric material project in to said elongated hollow elements; said long thin tubes being filled and packed with a filler comprising one or more predetermined insulating materials; and said elongated hollow elements being woven into an insulating fabric structure pattern forming a pipe wrap for insulating a cylindrical element.

4. The insulating product according to claim 1, wherein said insulating fabric is in the form of a blanket.

5. The insulating product according to claim 1, wherein said insulating fabric is in the form of a drape.

6. The insulating product according to claim 1, wherein said insulating fabric is in the form of a sleeping bag.

7. The insulating product according to claim 1, wherein said insulating fabric is in the form of sleep wear.

* * * * *